United States Patent [19]

Argazzi

[11] Patent Number: 4,614,073

[45] Date of Patent: Sep. 30, 1986

[54] METHOD AND APPARATUS FOR PROCESSING AND PACKAGING IN BOXES TUBULAR SQUEEZABLE CONTAINERS

[75] Inventor: Ivo Argazzi, Pianoro Nuova, Italy

[73] Assignee: IMA - Industria Macchine Automatiche SpA, Ozzano Emilia, Italy

[21] Appl. No.: 730,288

[22] Filed: May 3, 1985

[30] Foreign Application Priority Data

May 9, 1984 [IT] Italy ..... 3455 A/84

[51] Int. Cl.[4] ..... B65B 7/14; B65B 57/10

[52] U.S. Cl. ..... 53/54; 53/446; 53/469; 53/481

[58] Field of Search ..... 53/469, 467, 473, 481, 53/480, 373, 371, 251, 250, 243, 53–54, 131, 446, 544

[56] References Cited

U.S. PATENT DOCUMENTS

| | | | |
|---|---|---|---|
| 2,829,478 | 4/1958 | Engleson et al. | 53/251 |
| 3,133,393 | 5/1964 | Jones | 53/251 |
| 3,768,229 | 10/1973 | Bross et al. | 53/243 X |
| 3,878,665 | 4/1975 | Couten | 53/251 X |
| 4,510,736 | 4/1985 | Müller | 53/373 X |

FOREIGN PATENT DOCUMENTS

| | | |
|---|---|---|
| 431302 | 7/1935 | United Kingdom . |
| 1044181 | 9/1966 | United Kingdom . |
| 2075475 | 11/1981 | United Kingdom . |

*Primary Examiner*—James F. Coan

*Attorney, Agent, or Firm*—Karl F. Ross; Herbert Dubno

[57] ABSTRACT

Picking up in a positive manner from a feeding hopper in individual sequence horizontally positioned tubes, feeding them by gravity and delivering them, always positively held, to an element that from the horizontal pick-up position inserts them positively in a vertical plane with their open ends upwards in clamping elements on a processing line along which, advancing in increments, they are filled and closed and sealed in a conventional manner along the end thereof. Thereafter, synchronized with the incremental advance along the processing line, the tubes thus filled and end sealed, are successively gripped by transfer elements that insert them in preassembled boxes having their introduction opening facing upwards, at a packaging station, and there the tubes are packed inside the appropriate boxes with the introduction opening of the box being then closed.

8 Claims, 2 Drawing Figures

METHOD AND APPARATUS FOR PROCESSING AND PACKAGING IN BOXES TUBULAR SQUEEZABLE CONTAINERS

FIELD OF THE INVENTION

The present invention covers a method for setting up and packaging in boxes tubular preformed open-ended squeezable containers and an appropriate filling and packaging machine.

BACKGROUND OF THE INVENTION

At present the setting up and packaging in boxes of tubular containers of the so-called squeezable type for more or less viscous paste products is carried out in two distinct stages, in one of which the preformed open-ended squeezable tubes are filled in series through their open end which is then closed for example via one or more folds of the terminal section of the tube end, and in the second the tubes thus set up are packaged in boxes that are either assembled or not. The undertaking of these distinct stages of setting up and packaging respectively on the equipment or so-called automated machines known today takes place on two distinct separate machines with or without more or less automated and synchronized devices connecting the two machines.

On these known equipment or machines the tubular containers or tubes to be set up, advancing incrementally along the setting-up line of the filling machine for filling from the open end and sealing thereof on completion of the filling operation in more than one stage, firstly for example during the successive feeding of the tubes to said setting-up line, are free because released when going from a holding or control and transfer element to a subsequent element, and also, again by way of example, as regards the stage of their packaging in boxes, whereby besides a possible degradation of their characteristics following creasing or kinks that could be caused on their outer surface or skirt due to the actual time required for the various operations, or because of other reasons, the working speeds are conditioned by output rates per unit of time that often are found insufficient and in any case limited.

Attempts to overcome the above-mentioned speed limits of the machines at present known and obtain a higher output rate per unit of time have indeed taken place with machines with so-called multiple setting-up lines, with a plurality of individual operating units. Such a proposition for realizing machines with multiple setting-up lines has substantially suggested to dispose the operating units in such a way as to interconnect them to an appropriate control system drawing its power from a single motion source. With these machines the output speed could be increased, but it is evident that for dynamic reasons it can never be increased proportionally to the number of operating units adopted, that is doubled, trebled, etc., as the reciprocating masses would consequently be increased, thus reducing the unit speed and therefore the overall speed. In fact, if with a machine with a single setting-up line having rotating and linearly moving elements with a reciprocating action it is possible to reach the maximum typical speed, or speed One, of products per minute, it is clear that the speed obtainable by doubling said mobile operating units connected to a single source of motion cannot be doubled because the units added and their respective components, obviously dimensionally oversized, would in fact considerably increase said moving masses. Furthermore, if in regard to these machines with multiple operating units one considers also the problem of simultaneous feeding, it becomes even more evident that on such machines the increase in output speed per unit of time can never be proportional to the increase in the individual units and how they will never embody on a practical plane particular technical and economic features that are advantageous in relation to the use of a corresponding number of individual conventional machines. The technical and financial benefits that could derive from these multiple setting-up line machines are evidently even less tangible on the practical-productive plane when one considers that the above-mentioned structuring into multiple operating units with a single motion source, due to the position that said units in their respective individual configurations would necessarily have as an assembly, limits the machine performance denying it the character of universality traditionally appreciated in the specific field of use due to the practical and financial advantages deriving from the use of a universal machine with a single setting-up line.

OBJECTS OF THE INVENTION

The main object of this invention is to obviate said drawbacks by proposing a method and a machine operating in such a way as to make possible the automation of such a method so that the tubes during their setting up and packaging in boxes are always handled in a way that does not subject them to negative strains as they are constantly held, protected and guided from the feeding stage along the setting-up line to that of packaging in boxes that are either preassembled or not.

A second object of the invention is to propose a filling-packaging machine able to work at high speed with an output rate of packaged tubes in boxes per unit of time considerably higher than that of the machines generally known and used in this field.

A further object of this invention is to propose a machine in conformity with the previous objects and such that the filling section can be used for setting up the tubes to be fed to a section of a packaging machine in boxes, self-standing, of any known type.

SUMMARY OF THE INVENTION

This invention, on the other hand, proposes instead to make available a method and a filling-packaging machine that are able to reach a high output rate through a single operating unit, thus maintaining the main feature of the practical universality in accordance with the appreciated features of originality of the conventional machines.

In order to implement in a practical way such a machine the Applying Company, contrary to the principle based on an increase in the number of operating units that, as said earlier, implies an increase in the moving masses, relies instead on the opposite principle, that of shortening the operating times and considerably reducing the moving masses. Following this principle, on the basis of the method according to the present invention, a machine embodiment has been developed with coordination of movement between kinematic components in such a way that it is possible to have an exact distribution of the time-synchronization and a sensible combination of the functions so as to eliminate downtimes and be able to assign to each operation motion a dwell time strictly sufficient to ensure performance of the relevant operation. The invention has succeeded in this by going outside the traditional structuring parameters of such machines that, as is known, envisage the use of reciprocating elements or, as has already been said, in an attempt to increase the maximum speed typical of these conventional machines, adopt multiple unit machines, in effect structuring in particular the elements that feed and transfer the individual tubes with a view to a positive functioning.

In fact, according to one of the main features of the method within this invention that enables the filling-packaging machine in question to operate at high speed with an output of processed and packaged tubes per unit of time considerably higher than that of the machines generally used in this field, it consists in picking up from the feeding hopper individual sequence the tubes horizontally positioned before processing them in a positive manner, rather then feeding them by gravity, and delivering them, always in a positive manner, that is held, to an element that from the position of horizontal pick-up inserts them positively on a vertical plane with their open end upwards inside gripping elements on the setting-up or processing line along which, advancing sequentially, they are filled and sealed in a conventional way by closing the ends thereon. At this point, always synchronized with the sequential advance along the setting-up line, the tubes thus set up, that is filled and end-sealed, are successively gripped by transfer devices that insert them in the relevant preassembled boxes with their introduction opening facing upwards, that have been fed, always positively, again in successive sequence, to a boxing station, and are then packaged inside the corresponding boxes by the closure of the introduction opening.

Therefore, a major feature of the filling-packaging machine according to the present invention lies in providing this machine with a hopper for containing horizontally positioned open-ended tubes to be set up, a machine structured so as to feed the tubes after picking them up individually from inside the hopper through positive transfer devices that lift them from the hopper bottom, near one of its side walls, and deliver them one after the other to the top of a conveying duct external to the hopper that directs them downwards to positive clamping devices that feed them by transfer to the setting-up line, in a vertical position, with their open end upwards.

Another major feature of the machine in question lies in the fact that the tubes already set up along the setting-up line are positively and successive picked up from the latter in their vertical position, by the traditionally flattened end, and directly inserted in preassembled vertical boxes with their introduction opening opened, according to a pre-established desired position, with the flattened end parallel to two sides, or approximately following a diagonal line of the relevant box.

A further feature of the machine according to the invention lies in the particular structural configuration of the packaging machine, in particular the device that feeds the blanks and contemporarily forms the boxes, and in its typical configuration in the kinematic structure of a filling-packaging machine, capable of operating the machine smoothly and uniformly in rapid succession.

With a machine with the above characteristics of principle, and thanks to an accurate analytic study of the paths covered by the products being processed, as well as the elimination of reciprocating movements of driven elements and in particular for feeding pieces to the setting up line, it has been possible to obtain an operational speed that is approximately double that reached with the machines either known or proposed up to now.

Lastly, a further but not less important fact regarding the machine according to the invention is that it has been possible to construct such a machine with a particularly simple structure, easy and reliable in use, of long life, and above all also at a relatively economical cost considering the high output ensured by it.

These and other aims and advantages, better described later, are all obtained with the filling-packaging machine according to the invention for the setting up and packaging in boxes of tubular preformed open-ended squeezable containers for more or less viscous paste products, a machine characterized in that it comprises a hopper containing horizontally positioned open-ended tubes, positive action devices for picking up successively and individually the open-ended tubes in order to feed them, again individually, to positive pick-up devices for their transfer to orienting and transfer clamping devices that move them, vertically and with the open end upwards, to flexible gripping devices connected to closed loop means conveying them over a horizontal plane in increments along the machine's setting-up line, said tubes advancing along said setting-up line and successively stopping at stations that undertake a presence check, a cap tightening, a tube cleaning, a printing centering, a rejection of defective tubes, a filling in one or more successive stages through the open end upwards and a sealing operation of the end in a conventional manner, such means being suited to picking up blanks and at the same time form them into packaging boxes with the introduction opening facing upwards, clamping devices suited to gripping the sealed tubes by picking them up by their flattened end from the said setting-up line and transferring them into an appropriate box through the introduction opening with the flattened end parallel to two opposite sides, or approximately following a diagonal line within the relevant box, and devices suited to close the introduction opening of the box.

BRIEF DESCRIPTION OF THE DRAWING

Further features and advantages of the method and the filling-packaging machine according to this invention for automating the method shall become more evident from the detailed description that follows of a preferred practical embodiment given here purely by way of a example in which.

SPECIFIC DESCRIPTION

The method in question for the processing and packaging in boxes of tubular containers of the so-called squeezable preformed open-ended type for more or less viscous paste products provides the positive successive picking up of individual tubes from a hopper containing them in a horizontal position in order to deliver them, always positively, held, to devices which by holding them transfer them from the horizontal position to flexible gripping devices, in a vertical position and with the open end facing upwards, for displacement along a processing line.

The tubes that have thus been placed in a vertical position and are advancing incrementally along the processing line are filled through their open end, in one or more successive stages, and conventionally sealed for example by folding their preflattened end area to create a seal.

The tubes thus closed and sealed are then picked up from the processing line by their flattened and sealed end and introduced inside a corresponding box that in the meantime has been fed, in a vertical position, with its introduction opening facing upwards which is later closed.

According to the method in question the boxes can be set up during the processing stage, or can be picked up already set up with their introduction ends open. Furthermore, the introduction of tubes in the relevant boxes can be carried out with the flattened ends of the tubes parallel to two opposite sides of the corresponding box or with the flattened end approximately following a diagonal line of the box itself.

Figure 1:
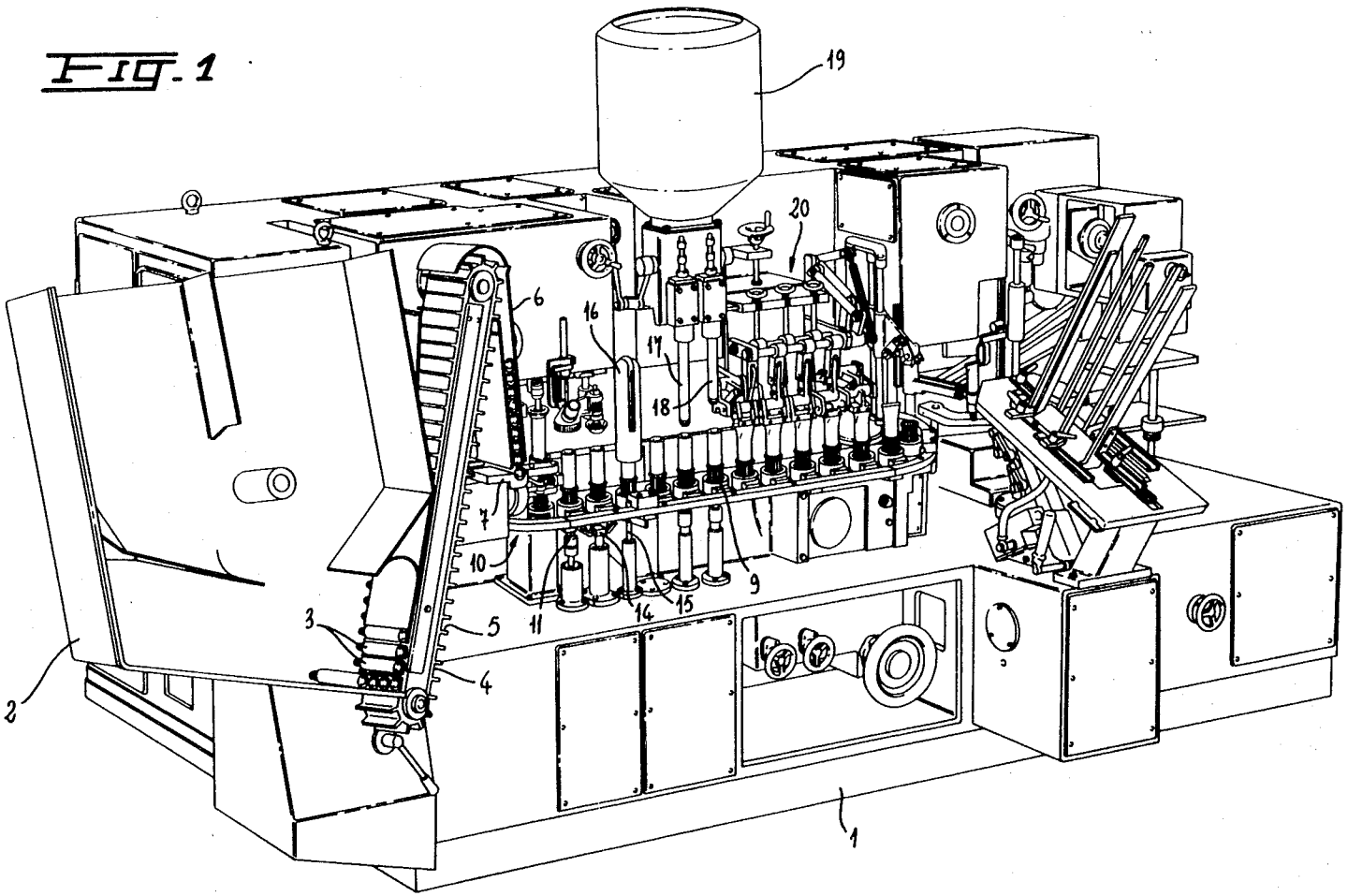
FIG. 1 is a front perspective view of the apparatus according to the invention.
Figure 2:
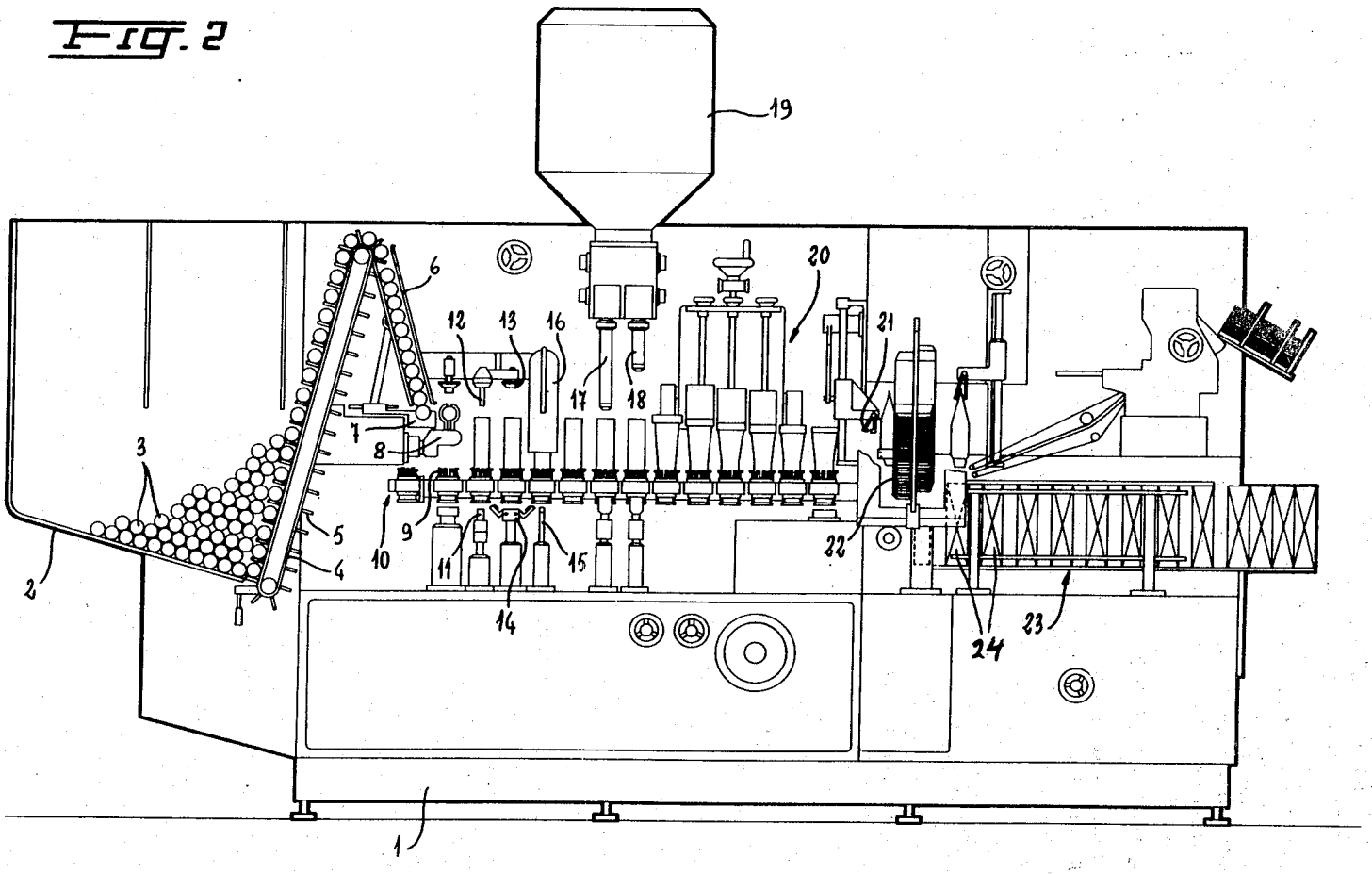
FIG. 2 is a front elevational view thereof.

With reference to FIGS. 1 and 2, there is shown by way of example a practical implementation of the filling-packaging machine for automating the method according to the present invention, the machine comprising an elongated bed 1 which at the left end, when looking at the Figures, supports a hopper 2 containing horizontally positioned preformed open-ended tubes 3.

The hopper 2 has a bottom sloping downwardly toward the center of the machine and its right side wall, is partially defined, more exactly in the lower portion thereof, by a closed loop conveyor 4 having pockets 5 for picking up the individual tubes 3 one at a time. The conveyor 4 with pockets 5 slopes upwards toward the center of the machine and at the top, ends level with a chute 6 into which are unloaded tubes 3 picked up horizontally positioned by the conveyor 4 with pockets 5 from within the hopper 2.

The chute 6 slopes downwardly to the right from the upper end of the pocket conveyer 4 and at the bottom ends level with a cradle transfer element 7 that receives tubes 3 arriving individually from chute 6. The crade transfer element 7 has an horizontal reciprocating movement and therefore is able to transfer positively in individual succession tubes 3 to a clamping element 8. The clamping element 8, besides the synchronized opening and closing movement of the jaws that grasp tubes 3 horizontally from the cradle of the corresponding transfer element 7, has also a rotational alternating movement about a horizontal axis so that it can insert vertically, obviously always individually, tubes 3 with their open end upwards, within flexible gripping devices 9 connected to conveying device 10, moving in a closed loop in a horizontal plane in successive increments or steps, forming the processing line of the machine's filling section.

Along the processing line the tubes thus vertically set up with their open end upwards stop in succession at operating stations, for example for checking the presence of the closure cap and for tightening this with tightening device 11, for cleaning the tubes by means of a blowing and suction device 12, for centering the printing with the help of mobile upper element 13 and rotary gripping device 14, and for ejecting defective tubes by means of ejector 15 through a discharge duct 16 to the back of the machine.

Along the processing line the tubes are stopped also in alignment with stations that fill them in two successive stages through their open end by means of elements 17 and 18 connected to a container 19 with the paste product, sealing the end by means, for example, of folding and crimping elements shown as an assembly 20, after flattening the terminal area of the tubes that forms their end.

At this point, clamping elements 21 pick up the closed and sealed tubes from the processing line and transfers them into an appropriate box with its introduction opening facing upwards. In the specific embodiment shown in the drawings, the boxes 24 are set up with the introduction end open, after picking up the blanks from a blank magazine 22. After feeding and introduction of instruction leaflets in the boxes 24, the latter are then transferred to the box closure line 23 of the machine's packaging line along which the closure of the introduction opening takes place.

The description of the filling-packaging machine in question with reference to the drawings obviously is given exclusively by way of example and evidently cannot be the subject of all those modifications and variants suggested by experience.

I claim:

1. A method for processing and packaging in boxes squeezable preformed open-ended tubular containers for substantially viscous paste products, comprising the steps of:

(a) feeding said containers successively in a horizontal position from a hopper along a transport path traversed by each of said containers in turn to a first transfer device located along said path;

(b) positioning each of said containers vertically at said transfer device with the open end thereof facing upwardly;

(c) inserting each of said containers vertically into a respective flexible gripping device with the open end of said containers facing upwardly;

(d) advancing said gripping devices with said containers along said path in increments into registration with at least one filling station located along said path for injecting said paste in turn into each of said containers through the open ends thereof;

(e) further advancing said gripping devices with said filled containers along said path in increments into registration with a folding and crimping station located along said path for closing and sealing in turn the open ends of said filled containers;

(f) forming said boxes from packaging blanks and positioning in turn each box along said path with an introduction opening thereof facing upwardly;

(g) advancing said sealed containers in increments along said path into registration with a second transfer device located along said path for inserting in turn each of said sealed containers into a respective box through the introduction opening thereof; and (h) closing in turn the respective introduction opening of each of said boxes after the insertion therein of a sealed container.

2. The method defined in claim 1, comprising after step (c) the further steps of:

checking for the presence of a closure cap on each of said containers and tightening same;

cleaning said containers;

centering and rotating each of said containers in turn for printing thereon; and detecting and ejecting in turn those containers from said containers found to be defective.

3. An apparatus for processing and packaging in boxes squeezable preformed open-ended tubular containers for substantially viscous paste products, comprising:

a hopper for holding a supply of said containers stored in a horizontal position, said hopper being located along a transport path;

a first transfer device spaced from said hopper downstream along said path;

means for feeding in individual succession each of said containers in turn from said hopper along said path to said first transfer device;

clamping means at said first transfer device for positioning in turn each of said containers vertically with the open end thereof facing upwardly;

at least one flexible gripping device mounted on a loop conveyer and displaceable in increments along said path, whereby said flexible gripping device can be brought into registration with said clamping means for inserting in turn each of said containers vertically into said flexible gripping device with the open end of the respective container facing upwardly;

means for checking the presence and tightening of a closure cap on each of said containers located along said path when said flexible gripping device is brought into registration with said means for cleaning;

means for cleaning each of said containers located along said path when said flexible gripping device is brought into registration with said means for cleaning;

means for centering each of said containers for printing thereon located along said path when said flexible gripping device is brought into registration with said means for centering;

means for ejecting defective containers located along said path when said flexible gripping device is brought into registration with said means for ejecting;

a filling station along said path for injecting said paste in at least one stage in turn into each of said containers through the open end thereof;

a folding and crimping station along said path for closing and sealing in turn the open ends of each of said filled containers;

means for forming said boxes from packaging blanks and positioning in turn each box along said path with an introduction opening formed in each box facing upwardly;

a second transfer device along said path at said positioned box for engaging a closed and sealed end of a respective sealed container in registration with said second transfer device, said second transfer device inserting said sealed container into said positioned box through the introduction opening thereof; and means for closing the introduction opening of each of said boxes after the insertion therein of a sealed container.

4. The apparatus defined in claim 3 wherein the closed and sealed ends of said containers are flat and said containers are inserted into respective boxes with the flat end of the container lying parallel to two opposite sides of the respective box.

5. The apparatus defined in claim 3 wherein the closed and sealed ends of said containers are flat and said conatiners are inserted into respective boxes with the flat end of the container lying along a diagonal of the respective box.

6. The apparatus defined in claim 3 wherein said feeding means includes a loop conveyer formed with pockets for holding individual containers in a horizontal position.

7. The apparatus defined in claim 3 wherein said first transfer device includes a cradle transfer element being reciprocatingly displaceable along said path from a receiving position in which a respective container is deposited into said cradle element from said feeding means to a removing position in which said clamping means removes the respective container from said cradle element.

8. The apparatus defined in claim 5 wherein said second transfer device includes a clamping element for engaging the closed and sealed ends of said containers.

* * * * *